US007255164B2

(12) United States Patent
Tulloch et al.

(10) Patent No.: US 7,255,164 B2
(45) Date of Patent: Aug. 14, 2007

(54) CASING BRUSH ASSEMBLY

(75) Inventors: Rory Tulloch, Aberdeen (GB); Bruce McGarian, Aberdeen (GB)

(73) Assignee: Smith International, Inc., Houston, TX (US)

( * ) Notice: Subject to any disclaimer, the term of this patent is extended or adjusted under 35 U.S.C. 154(b) by 216 days.

(21) Appl. No.: 11/076,042

(22) Filed: Mar. 10, 2005

(65) Prior Publication Data

US 2005/0205251 A1 Sep. 22, 2005

(30) Foreign Application Priority Data

Mar. 11, 2004 (GB) ..... 0405523.2
Nov. 15, 2004 (GB) ..... 0425183.1

(51) Int. Cl.
*E21B 37/08* (2006.01)

(52) U.S. Cl. ..... 166/173

(58) Field of Classification Search ..... 175/170, 175/173, 176
See application file for complete search history.

(56) References Cited

U.S. PATENT DOCUMENTS 4,438,812 A * 3/1984 Hammon ..... 166/173
6,152,220 A * 11/2000 Carmichael et al. ..... 166/173
6,530,429 B2 * 3/2003 Howlett ..... 166/173
6,655,462 B1 * 12/2003 Carmichael et al. ..... 166/311
7,137,449 B2 * 11/2006 Silguero ..... 166/301
2001/0040035 A1 * 11/2001 Appleton et al. ..... 166/387

* cited by examiner

*Primary Examiner*—William P Neuder
(74) *Attorney, Agent, or Firm*—Dykema Gossett PLLC

(57) ABSTRACT

A casing brush assembly comprises a mandrel, upper and lower stabilisers, a brush and a magnet assembly. The magnet assembly comprises a plurality of helically extending brush elements each of which is spaced from the underlying mandrel so that it can flex inwardly to accommodate variations in casing diameter. The thickness of the brush elements is relatively thin in the portions which connect the central regions to the ends of the brush with the result that the deflection of the brush elements is largely accommodated by the relatively thin regions. The magnet assembly includes three rings of magnets held in a non-magnetic cage and located beneath a thin cover of non-magnetic material. The assembly can be used in a non-rotating mode (in which the brush is free to rotate relative to the mandrel) or in a rotating mode in which the brush is rotationally fast with the mandrel.

23 Claims, 3 Drawing Sheets

CASING BRUSH ASSEMBLY

This invention relates to a casing brush assembly that is a tool for use in a wellbore to brush debris from the interior of the wellbore casing.

In wellbore clean-up and mud displacement operations it is well known to use a casing brush assembly to remove debris from the interior surface of the casing. Casing brushes may be non-rotating (that is there is substantially no rotation of the casing brush relative to the casing) or may be rotating (in which case the brush is forcibly rotated relative to the casing to increase the brushing action). In many clean-up operations, particularly on newly cased wells, non-rotating brushes are preferred because of their relatively less aggressive brushing action. However, in other clean-up operations a more aggressive action produced by rotating the brush at, for example, 40-120 rpm, is preferred. However, in general the more aggressive action is not preferred since it may lead to unsatisfactory casing wear and/or excessive bristle wear or breakage.

Casing brush assemblies are available from a number of commercial sources, and the present invention provides an improved design in this type of tool. One particular problem with use of conventional casing brushes is that the inside diameter of the casing being cleaned may vary significantly from its nominal value as a result of manufacturing tolerances or specific deformations or debris items. With conventional brushes, if an area of significantly reduced diameter is encountered the brush may jam and/or the bristles may be plastically deformed, broken, or unseated. The present invention provides a design which substantially reduces or eliminates this problem.

According to a first aspect of the present invention there is provided a casing brush comprising: a mandrel; and a brush mounted on the mandrel, the brush comprising an upper collar, a lower collar and a plurality of elongate brush elements extending between the upper and lower collars, each brush element having an inner surface radially spaced from the underlying mandrel and a central region having a plurality of wire bristles on the radially outer surface thereof wherein the brush is flexible such that, in use, if the brush is forced through the zone of casing of reduced inside diameter the brush elements will flex radially inwardly to reduce the bending load on the bristles before the bristles plastically deform, break, or are unseated from the brush elements.

By making the brush elements flexible and providing a radial clearance between the inner surface of the brush elements and the underlying mandrel, and by appropriate selection of the characteristic flexibility of the brush elements, a mechanism is provided for alleviating the problems encountered in the prior art which resulted in plastic deformation, breakage or unseating of the bristles.

Preferably, the radial thickness of the material making up the collars and the central regions of the brush elements is greater than the corresponding radial thickness of the portions of the brush elements which lie between the central regions and the collars whereby radial flexing of the brush elements is largely accommodated by the relatively thin-walled portions of the brush elements located between the central regions and the collars.

Preferably, each brush element is part helical over at least some of its length. In the preferred embodiment of the invention each blade element is part helical over the central region thereof and the end regions of each blade element (that is the regions between the central element and the respective collars) is substantially completely axially extending. The result of this arrangement is that the end regions of each brush element are circumferentially offset from each other. This arrangement allows substantially complete 360° coverage with bristles whilst at the same time enhances the ability of the brush elements to deflect resiliently radially inwardly when significantly reduced casing diameters are encountered.

Preferably, the casing brush assembly includes, in addition to the brush and mandrel, at least one magnet assembly. If only one magnet assembly is provided it will be located downhole of the brush to attract any iron or steel debris removed by the brush as the tool is moved uphole, or it will be located uphole of the brush to attract any iron or steel debris removed by the brush as the tool is moved downhole. The magnet assembly will also collect any steel bristles which are inadvertently broken or unseated during the brushing operation. In alternative embodiments of the invention magnet assemblies are provided on both sides of the brush so that debris will be collected during both upward and downward cleaning operations and, the tool may, if desired, be inverted.

Preferably, the brush and any magnet assemblies are mounted on the mandrel for free rotation relative to the mandrel. With such an arrangement the brush may be used in a "non-rotating" mode, that is a mode in which the brush does not rotate substantially relative to the casing regardless of the fact that the mandrel may be rotating to provide drive to other components located downhole of the brush. Preferably, means are provided for optionally locking the brush and any other components associated with it relative to the mandrel so that the casing brush assembly may be used in a rotating mode.

Preferably, any magnet assembly used as part of the casing brush assembly comprises three longitudinally adjacent circumferentially extending rings of magnets. Preferably, all the poles of the top and bottom rings of magnets are oriented so that the same pole is facing radially outwardly. Preferably, all the magnets of the middle ring are orientated so that the pole which is opposite to the outwardly facing poles of the upper and lower rings is facing radially outwardly. Preferably the middle ring magnets are staggered from the magnets of the upper and lower rings. Preferably, radially inward of the magnets is a sleeve of magnetic alloy whilst radially outwardly of the magnets is a sleeve, which should be as thin as possible, of non-magnetic material. Preferably the magnets are located relative to each other by a non-magnetic cage. This arrangement maximises the magnetic field produced adjacent the magnets.

Preferably, the brush has castellations formed at the longitudinally opposite extremities thereof for engaging mating castellations on adjacent components of the casing brush assembly to prevent rotation of the brush relative to the adjacent components. Preferably, the casing brush assembly comprises upper and lower stabilisers, one or more brushes, and one or more magnet assemblies, all of which components are provided with castellations to enable the entire assembly of components to be locked together for rotation as a single unit. This ensures that when the mandrel rotates the only wear which occurs is in the stabilizer ball bearings and journal bearing areas.

Preferably, a ring nut is mounted on the mandrel with a castellated end region for engaging a complementary castellated end region of one of the stabilisers. When the tool is required to operate in a non-rotating mode the ring nut is held spaced from the adjacent stabiliser so that the brush and its associated components can rotate freely relative to the mandrel. If, however, the brush assembly is required to operate in a rotating mode the ring nut may be screwed along the mandrel to engage the castellations of the ring nut with the castellations on the adjacent stabiliser in order to lock the stabiliser (and accordingly any components rotationally fast with the stabiliser) against rotation relative to the mandrel.

The invention will be better understood from the following description of a preferred embodiment thereof, given by way of example only, reference being had to the accompanying drawings wherein.

Figure 1:
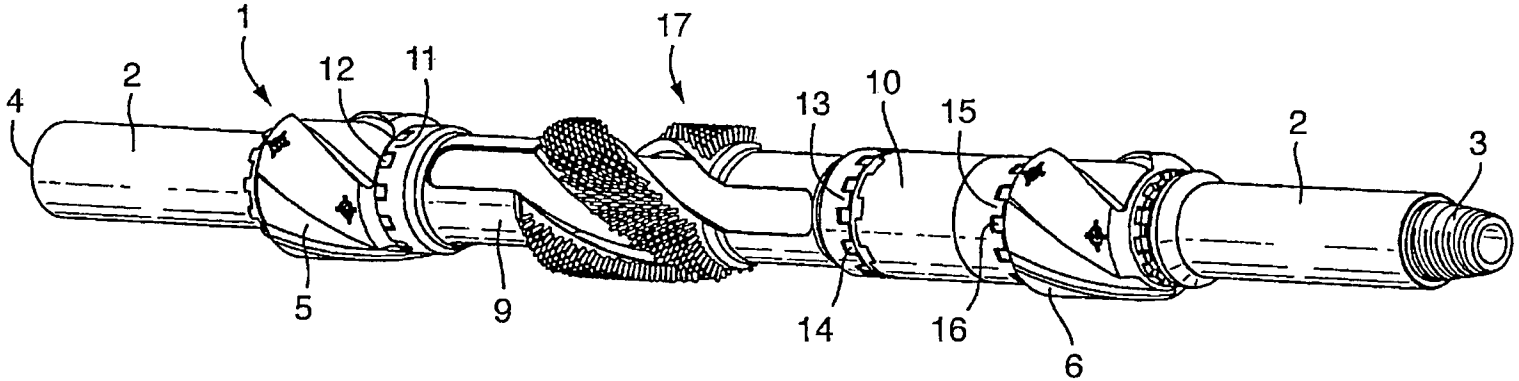
FIG. 1 is an isometric view of a casing brush assembly in accordance with a preferred embodiment of the present invention.
Figure 2:
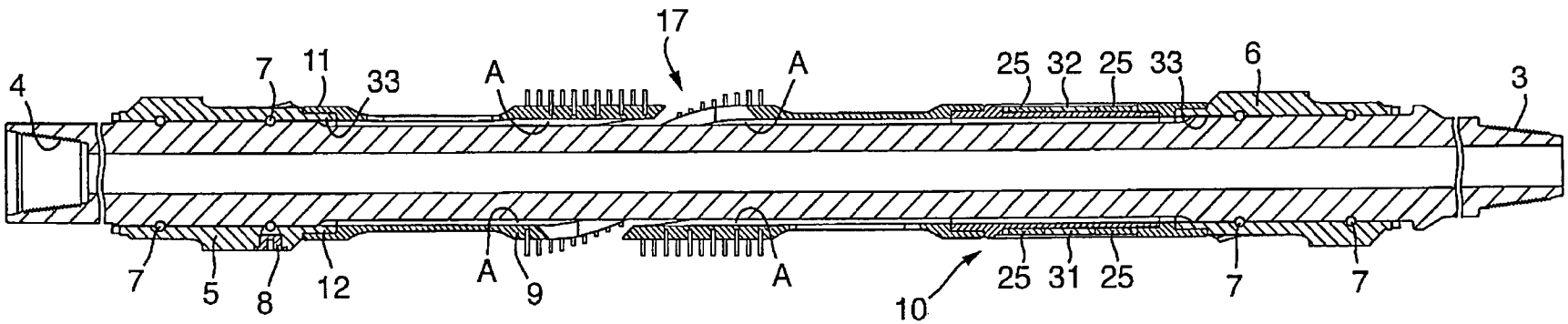
FIG. 2 is a longitudinal cross-section on a larger scale of the casing brush assembly of FIG. 1.
Figure 4:
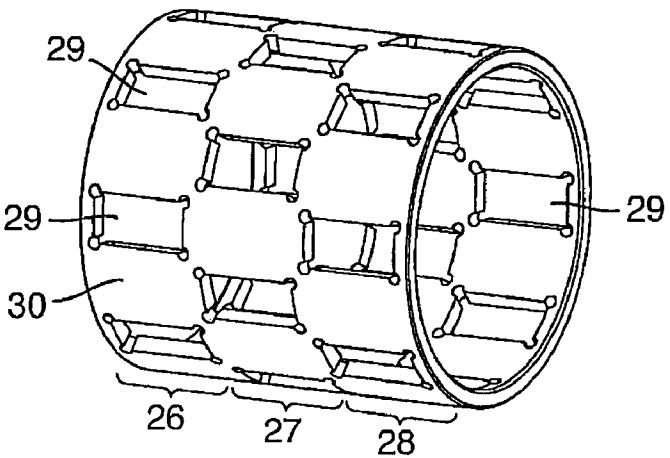
Figure 5:
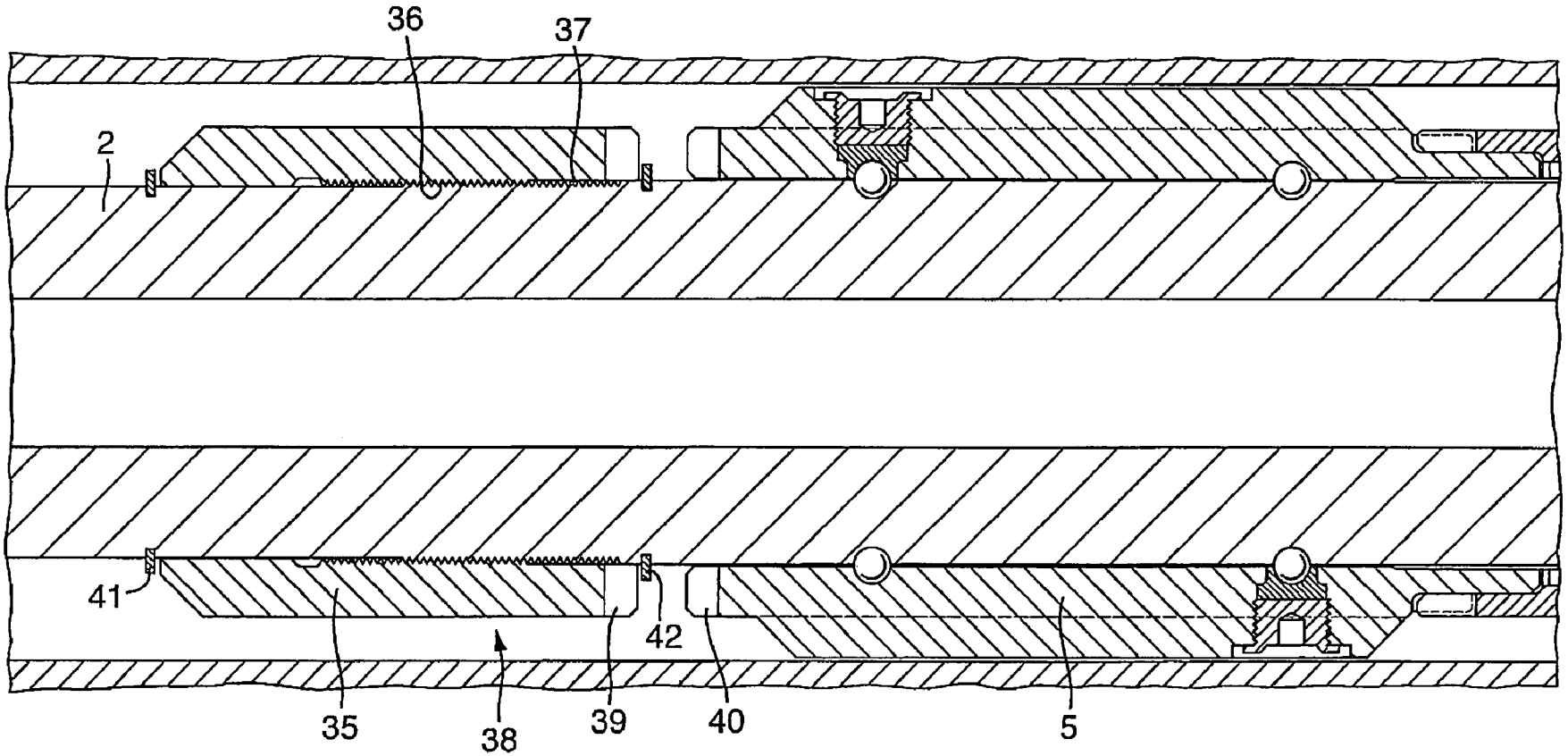

FIG. 4 is an isometric view of the cage of the magnet assembly used in the embodiment of FIGS. 1 and 2; and FIG. 5 is an enlarged axial cross-section showing an optional locking arrangement The casing brush assembly 1 shown in FIG. 1 comprises a mandrel 2 having a conventional pin connection 3 at the downhole end thereof and a conventional box connection 4 at the uphole end thereof to allow the casing brush assembly to be secured to other components of a tool assembly.

The mandrel 2 has rotatably mounted thereon upper 5 and lower 6 stabilisers each of which is rotatably secured to the mandrel by two ball bearings 7. Each ball bearing comprises a ball race formed in the outer surface of the mandrel, a ball race formed on the inner surface of the stabiliser, and a plurality of balls located between the races. A threaded plug 8 is provided for each ball bearing to enable the balls of the bearing to be inserted from the exterior of the associated stabiliser. Means, for example, bent over lugs on the plug which can be punched into slots in the stabilizer, are provided for preventing accidental release of the plugs. Under each of the plugs is a ball race insert which has a square cross-section in mid-length to stop the internal radius moving out of position over the ball grooves so that its internal radius matches the half circular groove of the ball race machined into the bore of the stabiliser body.

Located between the stabilisers is a brush 9 and a magnet assembly 10. The longitudinally upper end of the brush is formed with castellations 11 which mate with complementary castellations 12 formed on the lower end of the upper stabiliser 5 to prevent relative rotation therebetween. Similarly, the lower end of the brush 9 is formed with castellations 13 which engage complementary castellations 14 on the upper end of the magnet assembly 10 to prevent relative rotation therebetween and the lower end of the magnet assembly is formed with castellations 15 which engage complementary castellations 16 on the upper end of the lower stabiliser 6 to prevent relative rotation therebetween. Accordingly, the entire assembly 17 comprising the upper 5 and lower 6 stabilisers, the brush 9 and the magnet assembly 10 is locked against relative rotation and the whole assembly will remain rotationally stationary as the mandrel rotates by virtue of the ball bearings.

Although in the illustrated embodiment of the invention a single brush 9 and single magnet assembly 10 are located between the stabilisers 5, 6 it will of course be appreciated that if desired a plurality of brushes and/or a plurality of magnet assemblies may be provided between the stabilisers.

Figure 3:
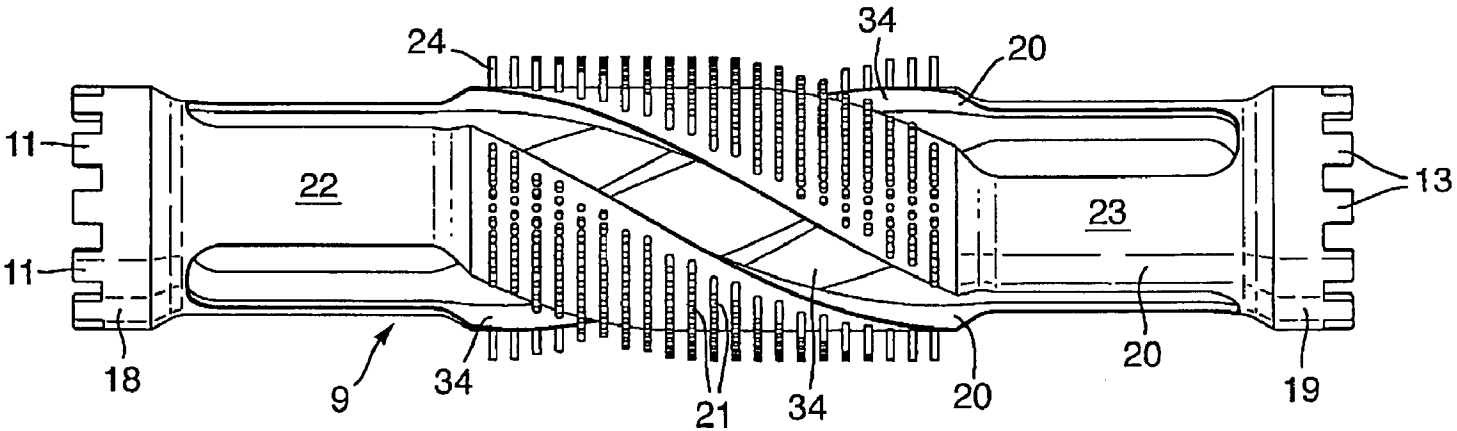
FIG. 3 is a side view of the brush of the casing brush assembly of FIGS. 1 and 2.

Referring now particularly to FIG. 3, a side view of the brush 9 is shown. The brush includes an upper collar 18 having the castellations 11 formed thereof and a corresponding lower collar 19 having the castellations 13 formed thereon. Extending between the collars are three brush elements 20 each of which comprises a central region 21 and two end regions 22, 23. It will be noted that the radial thickness of the walls of the collars 18, 19 and of the central regions 21 of the brush elements 20 are significantly greater than the radial thickness of the end regions 22, 23 of the brush elements.

The central region 21 of each brush element 20 is formed with a plurality of holes each of which receives one or more bristles 24. The bristles 24 are often of a hard metallic material (although the invention is not limited to such material) and may typically be of tinned and hardened tempered steel. The bristles may be secured by mechanical means and/or adhesive. Typically, the bristles may be made from a wire having a diameter of approximately 0.4 mm (0.016 inches). The relationship between the physical characteristics of the material of the bristles 24, the physical characteristics of the material of the end regions 22, 23 of the brush elements, the number and length of the bristles 24 and the thickness, width and length of the end regions 22, 23 is selected such that if the casing brush assembly is forced through an area of casing having an inside diameter significantly less than the nominal diameter of casing for which the casing brush assembly was designed, the central regions 21 of the brush elements 20 are able to flex radially inwardly to reduce the bending forces on the bristles 24 before the bristles plastically deform, break, or are unseated from the sockets provided in the central regions 21 the brush elements. To this end, a radial clearance is provided between the inner surfaces of the brush elements and the mandrel, in the relaxed state of the brush (FIGS. 1 & 2). Such an arrangement substantially reduces the possibility of bristle damage or breakage. The flexing of the end regions 22, 23 also results in the bristles being less bent over with respect to the casing bore and so a better brushing action will be obtained.

It will be noted that the central region 21 of each brush element 20 has a helical form whilst the end regions 22,23 are substantially straight and aligned with the axial direction of the tool. Such an arrangement ensures firstly that the end regions are able to provide the required resilient deformation in the event of a substantially reduced casing inside diameter being encountered, and also ensures that the bristles provide 360° coverage around the periphery of the casing.

The magnet assembly 10 comprises a plurality of magnets 25 preferably arranged in three rings 26, 27, 28, although more than three rings may be used if desired. In the illustrated embodiment of the invention each ring comprises eight magnets. Each magnet is generally rectangular in form and the magnets are located in respective pockets 29 provided in a cage 30. The cage 30 is formed of a non-magnetic material. The cage 30 is mounted on a sleeve 31 of magnetic material and the magnets and cage are covered by a thin outer sleeve 32 of non-magnetic material. The magnets are of such a nature that the poles are on the radially inner and radially outer surfaces of the magnets, relative to the axis of rotation of the mandrel. The magnets are arranged such that in the two outer rings 26, 28 of magnets the same pole of each magnet faces radially outwardly. For example, all magnets in the outer rings 26, 28 will be arranged so that the north poles are on the radially outer surface of the assembly. The magnets of the middle ring 27 are arranged inverted relative to the magnets of the outer two rings so that, in the example given, the south pole of each magnet in the middle ring will be located radially outwardly. This arrangement, combined with the illustrated circumferential offset of the middle ring of magnets relative to the outer rings of magnets leads to a high level of magnetic field strength and renders the magnet assemblies particularly effective at retaining ferro-magnetic material released as a result of the well cleaning operation.

It will be noted that in the above design there is no significant end float or radial float of the brush relative to the other components. In the longitudinal direction of the tool the position of the stabilizers 5, 6 is fixed by their associated ball bearings and the distance between the stabilizers is sufficient to permit mounting of the various components required after due allowance has been made for manufacturing tolerances, but insufficient to provide any significant end float for these components. Likewise, in the radial direction rings 32 provided on the stabilizers 5, 6 locate the end of the assembly of components located therebetween in the radial direction. Radial movement of the central region 21 of each brush element is accommodated by deflection of the end regions 22, 23 rather than by any overall radial movement of the brush. It should also be noted that the central regions 21 are themselves preferably rigid and the deflection of these rigid central regions is accommodated by deflection of the end regions 22, 23. In fact, because of the helical form of the central regions 21, the end regions 22, 23 will deflect in a complex mode involving both beam and tortional distortion in order to accommodate radial inward movement of the central regions 21. The rigid nature of the central regions 21 provide better control over the presentation of the bristles to the casing than would be the case if the central region itself was flexible and deformed as a result of casing diameter reductions. Also, the rigid central region is less liable to lose bristles than would be the case if a flexible central region was provided because it will not suffer from the periodic changes to the shape of the bristle holes which would occur if flexing was permitted.

It will be noted that the helical form of the central regions 21 not only facilitates 360° coverage of the casing, but also provides three relatively wide channels 34 which permit a high level of fluid flow past the brush. In general, the design will be such that the channels 34 provide a comparable flow area to that provided by the stabilizers 4,5.

It will be noted from FIG. 2 that the brush is located radially at the upper end thereof by a spigot provided on the lower end of the upper stabiliser 5 and that the magnet assembly 10 is located radially at the lower end thereof by a spigot provided on the upper end of the lower stabiliser 6. Similarly, the lower end of the brush 11 is located radially by a spigot provided on the upper end of the magnet assembly 10. The effect of this arrangement is that a working clearance can be provided between the brush and the mandrel and between the magnet assembly and the mandrel along the entire length of the assembly between the stabilisers. This will ensure that when the tool is working in a non-rotating mode, but the mandrel is rotating there is no rubbing engagement between the brush assembly or the magnet assembly and the mandrel.

It should also be noted that whilst castellations and spigots are the preferred method of locking the various components together in a rotational direction and providing the necessary radial support, other arrangements are possible. For example, dowl pins may be used to provide the required rotational locking and radial support.

FIG. 5 illustrates on an enlarged scale an arrangement which may be used for locking the brush and magnets relative to the mandrel. A lock ring 35 has internal screw threads 36 which mate with corresponding external screw threads 37 provided on the mandrel 2. The end 38 of the lock ring 35 adjacent the stabilizer 5 is formed with castellations 39 which can mate with complementary castellations 40 provided on the stabilizer 5. Normally, when the tool is required for use with the brush rotationally stationary, the lock ring 35 is maintained in the position illustrated in which the castellations 39 of the lock ring are spaced from the castellations 40 of the stabilizer 5 by means of circlips 41, 42 which are seated in grooves provided in the surface of the mandrel. When required for use, circlip 42 is removed and the lock ring 35 is rotated to engage the castellations 39 of the lock ring with the castellations 40 of the stabilizer. If desired, the circlip 42 may be placed in a further groove (not shown) provided in the mandrel in order to prevent reverse rotation of the locking ring. Once the locking ring has been positioned to interengage the castellations 39 of the locking ring with the castellations 40 of the stabilizer 5, and the lock ring has been tightened down to a suitable torque, relative rotational movement between the brush assembly and the mandrel will be prevented.

The invention claimed is:

1. A casing brush assembly comprising: a mandrel; and a brush mounted on the mandrel, the brush comprising an upper collar, a lower collar and a plurality of elongate brush elements extending between the upper and lower collars, each brush element having an inner surface radially spaced from the underlying mandrel and a central region having a plurality of wire bristles on the radially outer surface thereof, wherein the brush is flexible such that, in use, if the brush is forced through a zone of casing of reduced inside diameter the brush elements will flex radially inwardly to reduce the bending load on the bristles before the bristles plastically deform, break, or are unseated from the brush elements, wherein each brush element comprises a body having a central region to which the bristles are mounted, wherein the upper collar, the brush element bodies and the lower collar are a unitary structure, and wherein the radial wall thickness of the material making up the collars and the central regions of the brush element bodies is greater than the corresponding radial wall thickness of the portions of the brush element bodies which lie between the central regions and the collars whereby radial flexing of the brush element bodies is largely accommodated by the relatively thin-walled portions of the brush elements located between the central regions and the collars.

2. A casing brush assembly according to claim 1, wherein each brush element is part helical over at least some of its length and the brush elements, when viewed axially of the tool, provide a circumferentially continuous brushing area.

3. A casing brush assembly according to claim 2, wherein each brush element is part helical over the central region thereof and the end regions of each brush element (that is the regions between the central region and the respective collars) is substantially completely axially extending relative to the tool axis.

4. A casing brush assembly according to claim 1, having stabilisers at both ends of the brush.

5. A casing brush assembly according to claim 4, wherein the stabilisers are mounted on the mandrel by one or more ballbearings which locate the stabilisers on the mandrel and transmit thrust load from the stabilisers to the mandrel.

6. A casing brush assembly according to claim 5, wherein the magnets are located relative to each other by a non-magnetic cage.

7. A casing brush assembly according to claim 1, including, in addition to the brush and mandrel, at least one magnet assembly.

8. A casing brush assembly according to claim 7, wherein the at least one magnet assembly is provided on one side only of the brush to attract any iron or steel debris removed by the brush as the tool is moved in the direction in which the at least one magnet assembly is at the trailing end of the brush.

9. A casing brush assembly according to claim 7, wherein the at least one magnet assembly is provided on both sides of the brush.

10. A casing brush assembly according to claim 1, wherein at least one of the brush and magnet assemblies are mounted on the mandrel for free rotation relative to the mandrel.

11. A casing brush assembly according to claim 10, wherein means are provided for optionally locking the brush relative to the mandrel so that the casing brush assembly may be used in a rotating mode.

12. A casing brush assembly according to claim 11, having stabilisers at both ends of the brush, wherein the stabilisers are mounted on the mandrel by one or more ballbearings which locate the stabilisers on the mandrel and transmit thrust load from the stabilisers to the mandrel, and wherein the locking means comprises a locking ring threadedly mounted on the mandrel and movable to apply axial thrust load on one of the stabilisers.

13. A casing brush assembly according to claim 10, wherein radially inward of the magnets, is a sleeve of magnetic alloy whilst radially outwardly of the magnets is a thin sleeve of non-magnetic material.

14. A casing brush assembly according to claim 7, wherein the or each magnet assembly comprises three longitudinally adjacent circumferentially extending rings of magnets with all the poles of the top and bottom rings of magnets are oriented so that the same pole is facing radially outwardly.

15. A casing brush assembly according to claim 14, wherein all the magnets of the middle ring are orientated so that the pole which is opposite to the outwardly facing poles of the upper and lower rings is facing radially outwardly.

16. A casing brush assembly according to claim 14, wherein the magnets of the middle ring are circumferentially staggered from the magnets of the upper and lower rings.

17. A casing brush assembly according to claim 14, wherein the magnets are located relative to each other by a non-magnetic cage.

18. A casing brush assembly according to claim 7, wherein radially inward of the magnets, is a sleeve of magnetic alloy whilst radially outwardly of the magnets is a thin sleeve of non-magnetic material.

19. A casing brush assembly according to claim 1, wherein the brush has means formed at the longitudinally opposite extremities thereof for engaging mating means on adjacent components of the casing brush assembly to prevent rotation of the brush relative to the adjacent components.

20. A casing brush assembly according to claim 1, comprising upper and lower stabilisers, one or more brushes, and one or more magnet assemblies, all of which components are provided with means to enable the entire assembly of components to be locked together for rotation as a single unit.

21. A casing brush assembly according to claim 20, wherein a ring nut is mounted on the mandrel with a castellated end region for selectively engaging a complementary castellated end region of one of the stabilisers in order to lock the stabiliser (and accordingly any components rotationally fast with the stabiliser) against rotation relative to the mandrel.

22. A casing brush assembly according to claim 1, wherein at least one of the brush and magnet assemblies are radially located relative to the mandrel by components located opposite ends of the brush and magnet assemblies and a working clearance is provided between the brush and magnet assemblies and the mandrel.

23. A casing brush assembly according to claim 22, wherein the brush is located radially at least one end thereof by a magnet assembly.

* * * * *